US008631859B1

(12) United States Patent
Hettrich

(10) Patent No.: US 8,631,859 B1
(45) Date of Patent: Jan. 21, 2014

(54) MODULAR HEAT EXCHANGER

(75) Inventor: Edgar Hettrich, Middletown, CT (US)

(73) Assignee: Vista-Pro Automotive, LLC, Nashville, TN (US)

( * ) Notice: Subject to any disclaimer, the term of this patent is extended or adjusted under 35 U.S.C. 154(b) by 1231 days.

(21) Appl. No.: 12/263,836

(22) Filed: Nov. 3, 2008

(51) Int. Cl.
*F28F 9/26* (2006.01)

(52) U.S. Cl.
USPC ..... 165/144

(58) Field of Classification Search
USPC ..... 165/144
See application file for complete search history.

(56) References Cited

U.S. PATENT DOCUMENTS

| | | | | | |
|---|---|---|---|---|---|
| 690,704 | A * | 1/1902 | Dezell | 165/144 |
| 847,547 | A * | 3/1907 | Brown | 165/144 |
| 1,861,676 | A * | 6/1932 | Young | 165/124 |
| 2,237,516 | A * | 4/1941 | Young | 165/82 |
| 2,308,119 | A * | 1/1943 | Spieth | 165/83 |
| 4,076,072 | A | 2/1978 | Bentz | |
| 4,191,244 | A | 3/1980 | Keske | |
| RE30,766 | E | 10/1981 | Bentz | |
| 4,651,816 | A * | 3/1987 | Struss et al. | 165/76 |
| 4,673,032 | A * | 6/1987 | Hara et al. | 165/44 |
| 4,730,668 | A | 3/1988 | LeMaster | |
| 5,137,080 | A | 8/1992 | Haasch et al. | |
| 5,148,863 | A * | 9/1992 | Fouts et al. | 165/149 |
| 5,899,267 | A * | 5/1999 | Kroetsch et al. | 165/173 |
| 6,341,648 | B1 * | 1/2002 | Fukuoka et al. | 165/144 |
| 6,945,322 | B2 | 9/2005 | Ikeda | |
| 6,988,532 | B2 | 1/2006 | Hamada | |
| 7,000,689 | B2 * | 2/2006 | Finch et al. | 165/167 |
| 7,552,756 | B2 * | 6/2009 | Riniker et al. | 165/41 |
| 2009/0038778 | A1 * | 2/2009 | Korth et al. | 165/104.14 |

FOREIGN PATENT DOCUMENTS

| | | |
|---|---|---|
| JP | 05215465 | 8/1993 |

* cited by examiner

*Primary Examiner* — Brandon M Rosati
(74) *Attorney, Agent, or Firm* — Peter W. Peterson; DeLio & Peterson, LLC

(57) ABSTRACT

A heat exchanger includes an adapter header plate having a row of coolant openings, an adapter tank having a lip aligned with a heat exchanger core header and tubular protrusions corresponding to the coolant openings of the adapter header plate. Elastomeric grommets are inserted into the coolant openings of the adapter header plate for sealing the coolant openings to the tubular protrusions of the adapter tank. The heat exchanger includes an elongated filler frame member having an opening extending therethrough and opposing lips extending around each end of the opening. At least one tab of adjacent heat exchanger cores are secured to the filler frame member lips to connect at least two of the heat exchanger cores. A pair of opposing side members and a core support member centered between two heat exchanger cores are adapted to direct air flow to the fins and tubes of the heat exchanger cores.

15 Claims, 8 Drawing Sheets

MODULAR HEAT EXCHANGER

BACKGROUND OF THE INVENTION

1. Field of the Invention

The present invention relates to heat exchangers and in particular, to modular heat exchangers used with internal combustion engines in vehicles or industry.

2. Description of Related Art

Engine cooling radiators used with internal combustion engines in trucks or industry are often quite large. Those used with stationary diesel-electric generator sets in particular can have cores with an overall size of from six to eight ft. (1.8 to 2.4 m) on a side or even larger. Such radiators have usually been made with multiple cores because a single core of such size is difficult to manufacture. Industrial radiators such as these are typically of cooper/brass soldered construction, wherein solder-coated brass tubes are pushed through holes in a stack of copper fins, which have been held in the desired spacing in a grooved book jig, to form a core block. The core block is then baked in an oven to solder the tubes to the fins. Following this, the tube ends are inserted into brass headers at each end of the core block and soldered, to form a core. The height of such a core is limited by the ability to push long, thin tubes through the holes in the fins, with 48 in. (1.22 m) being close to a practical maximum. Similarly, the size of a typical book jig limits core widths to about 48 in. (1.22 m).

Therefore, to make a 72 in. (1.83 m) high core assembly, as the example, two 36 in. (91 cm) high cores are joined by bolting header-to-header, with a connecting frame and gaskets in between. Such a core assembly would be 72 in. (1.83 m) high (plus the thickness of the frame) and up to 48 in. (1.22 m) wide. It would have an inlet header at the top and an outlet header at the bottom to connect to inlet and outlet tanks.

To make a 72-in. (1.83 m) wide core assembly, two 36 in. (91 cm) wide core blocks are solder connected side-by-side to a single common inlet header at the top and a single common outlet header at the bottom. Usually a core separator strip is placed between the cores, primarily for appearance and to block any bypass cooling air between the cores. Such a core would be 72 in. (1.83 m) wide and up to 48 in. (1.22 m) high.

For a core assembly of overall size of 72 in. (1.83 m) by 72 in. (1.83 m), as shown in FIG. 1, two copper/brass core blocks 8' are solder connected side-by-side to a single common header 78 at the top and bottom of the core blocks 8' to produce a first core assembly. A second core assembly is constructed with two additional core blocks 8" and two additional headers 78. The 36-in. (91 cm) high, 72 in. (1.83 m) wide core assemblies are then joined to a connecting filler frame 15 by bolting, with gaskets between the filler frame and each core header, the gaskets substantially the same as the gasket 75 between the radiator tank 100 and the top header 78 of upper cores 8'. The headers 78 of the core pairs are bolted, with gaskets 75, to a steel inlet tank 100 and outlet tank (not shown) with a core separator strip 77 between the side-by-side cores. Such a large core assembly of copper/brass material is expensive for two reasons. First, the price of copper and copper-based alloys is expensive and, second, the manufacturing method associated with soldered copper/brass radiator construction is labor-intensive.

Automobile and heavy truck radiators have long since abandoned costly copper/brass radiator construction in favor of CAB (controlled atmosphere brazing) aluminum core construction with plastic tanks. PTA (plastic tank aluminum) radiators have tabbed aluminum headers which are crimped to a plastic radiator tank with an elastomeric gasket between. This type of construction is more automated, requires far less labor, is more consistent, uses less costly material, and results in a product which is lighter, stronger and which has demonstrated improved durability compared to copper/brass. However, the available CAB furnaces limit core size to not larger than about 48 inches square.

There is a need for a way to make large radiators for large vehicles and industrial applications using CAB aluminum cores.

SUMMARY OF THE INVENTION

Bearing in mind the problems and deficiencies of the prior art, it is therefore an object of the present invention to provide large radiator core assemblies having CAB aluminum core modules.

It is another object of the present invention to provide an adapter assembly for replacement of copper/brass cores with aluminum core assemblies for existing large radiators.

A further object of the invention is to provide a method for replacement of copper/brass cores with aluminum core assemblies for existing large radiators.

It is yet another object of the present invention to provide a modular heat exchanger which maximizes air flow over the heat exchanger core.

Still other objects and advantages of the invention will in part be obvious and will in part be apparent from the specification.

The above and other objects, which will be apparent to those skilled in the art, are achieved in the present invention which is directed in a first aspect to a modular heat exchanger core assembly comprising a plurality of heat exchanger cores, with each heat exchanger core including a plurality of tubes, fins between the tubes and opposing headers sealingly attached at each end of the tubes. Each header has at least one tab along the perimeter. Each modular heat exchanger has at least one elongated filler frame member having an opening extending therethrough and opposing lips extending around each end of the opening. Each lip corresponds with an adjacent heat exchanger core header, the at least one tab of each adjacent heat exchanger core header being secured to one lip of the at least one filler frame member to connect at least two of the heat exchanger cores. The at least one filler frame member preferably has a length corresponding to a width of the heat exchanger cores, and a width corresponding to the depth of the heat exchanger cores.

The modular heat exchanger core assembly may include a pair of opposing side members adapted to provide structural support to the heat exchanger cores and to substantially eliminate air flow bypass around the sides of the cores and may additionally or alternately include a core support member centered between two heat exchanger cores adapted to direct air flow to the fins and tubes of the heat exchanger cores.

Another aspect of the present invention is directed to a filler frame for securing a first heat exchanger core to a second heat exchanger core, the filler frame comprising openings on opposite ends thereof, each opening having a lip extending from the lip around the opening. The lip is adapted to connect to a header of the heat exchanger core by means of deformation of header tabs around the lip. Preferably, the filler frame has a length corresponding to a width of the heat exchanger cores, and a width corresponding to the depth of the heat exchanger cores. The frame may be plastic or reinforced nylon.

In a further aspect the present invention is directed to a method of connecting a plurality of heat exchanger cores. The method includes providing at least one pair of heat exchanger cores, each having a header with at least one tab along the perimeter and at least one elongated filler frame member having an opening extending therethrough with opposing lips extending around each end of the opening, each lip corresponding with an adjacent heat exchanger core header. The method includes attaching the heat exchanger core headers to the opposing lips of the at least one elongated filler frame member and deforming the at least one tab of the heat exchanger headers around the corresponding adjacent lip of the at least one elongated filler frame member to connect the heat exchanger cores.

The method preferably includes providing at least one gasket adapted to seal a lip of the at least one elongated filler frame member with the header of the adjacent heat exchanger core and placing the at least one gasket between the header of each heat exchanger core and the corresponding lip of the at least one elongated filler frame member prior to deforming the at least one tab around the lip of the corresponding at least one elongated filler frame member.

Another aspect of the present invention provides a method of making a heat exchanger of a desired width and height comprising providing a plurality of heat exchanger cores of different sizes, with each having a header at opposite ends thereof. A plurality of the heat exchanger cores are selected to create a desired array of columns and rows of the heat exchanger cores to correspond to the desired width and height. There is also provided a plurality of elongated filler frame members having an opening extending therethrough to connect headers of adjacent heat exchanger cores, at least one core support member adapted to direct air flow to the adjacent heat exchanger cores, and at least two side support members adapted to substantially eliminate air flow bypass around the sides of the heat exchanger cores. The method then includes attaching the heat exchanger cores in the columns using the elongated filler frame members, and securing the at least one core support member between adjacent columns of the heat exchanger cores. Tanks are connected to opposite ends of the adjacent columns of heat exchanger cores. The method further includes securing side support members on opposite sides of the adjacent columns of heat exchanger cores to provide structural support to the heat exchanger cores and to substantially eliminate air flow bypass around the sides of the heat exchanger cores.

In yet another aspect, the present invention is directed to an apparatus for connecting a heat exchanger core to a radiator tank. The apparatus includes an adapter header plate having a row of coolant openings and a plurality of mounting openings for fastening the plate to the radiator tank. The apparatus may also include a gasket for sealing the radiator header plate to the radiator tank. The apparatus also includes at least one adapter tank having a lip adapted to align with a heat exchanger core header and tubular protrusions corresponding to the coolant openings of the adapter header plate. Additionally the apparatus may include a plurality of elastomeric grommets insertable into the coolant openings of the adapter header plate for sealing the coolant openings to the tubular protrusions of the adapter tank. Preferably, the elastomeric grommets are cylindrical and the coolant openings of the adapter header plate are collared openings adapted to seal with the outer surface of the elastomeric grommets.

Another aspect of the present invention is directed to a method of connecting a heat exchanger core to a radiator tank. The method comprises providing a radiator tank, at least one heat exchanger core and an adapter header plate having a row of coolant openings and a plurality of mounting openings for fastening the plate to the radiator tank. The method additionally includes providing at least one adapter tank having a lip adapted to align with a header of the at least one heat exchanger core and tubular protrusions corresponding to the coolant openings of the adapter header plate. The method includes providing a plurality of elastomeric grommets insertable into the coolant openings of the adapter header plate for sealing the coolant openings to the tubular protrusions of the adapter tank and attaching the at least one adapter tank to the at least one heat exchanger core header. The method also includes inserting the elastomeric grommets into the coolant openings of the adapter header plate, inserting the tubular protrusions of the adapter tank into the corresponding elastomeric grommets and attaching the radiator tank to the mounting openings of the adapter header plate.

In a further aspect, the present invention is directed to a heat exchanger comprising an adapter header plate having a row of coolant openings and a plurality of mounting openings for fastening the plate to a radiator tank. The heat exchanger may include a gasket for sealing the adapter header plate to the radiator tank. The heat exchanger also includes at least one adapter tank having a lip aligned with a heat exchanger core header and tubular protrusions corresponding to the coolant openings of the adapter header plate. The heat exchanger also includes a plurality of elastomeric grommets inserted into the coolant openings of the adapter header plate for sealing the coolant openings to the tubular protrusions of the at least one adapter tank, and a plurality of heat exchanger cores. Each heat exchanger core includes a plurality of tubes, fins between the tubes and opposing headers sealingly attached at each end of the tubes, each header having at least one tab along the perimeter thereof. The heat exchanger also includes at least one elongated filler frame member having an opening extending therethrough and opposing lips extending around each end of the opening, each lip corresponding with an adjacent heat exchanger core header. The at least one tab of each adjacent heat exchanger core header is secured to a lip of the at least one filler frame member to connect at least two of the heat exchanger cores. Preferably the filler frame member has a length corresponding to a width of the heat exchanger cores, and a width corresponding to the depth of the heat exchanger cores. The heat exchanger preferably includes a pair of opposing side members adapted to provide structural support to the heat exchanger cores and to substantially eliminate air flow bypass around the sides of the cores and additionally or alternately includes a core support member centered between two heat exchanger cores adapted to direct air flow to the fins and tubes of the heat exchanger cores.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-9 of the drawings in which like numerals refer to like features of the invention.

The first embodiment of the present invention provides a complete modular radiator, intended to be a low-cost alternative to custom building a large industrial or vehicle radiator with copper/brass cores. Such a modular radiator consists of multiple PTA radiators typical of automotive applications. These PTA radiators are joined together vertically by substituting a joining filler frame member for the bottom tank of the upper radiator and the top tank of the lower radiator. The bottom header of the upper radiator and the top header of the lower radiator are crimped to the joining filler frame member with elastomeric gaskets. The multiple PTA radiators are assembled into a steel structural framework consisting of structural side pieces and upper and lower frame members. Multiple PTA radiators may be connected side to side by means of core support members between the cores.

Figure 2:
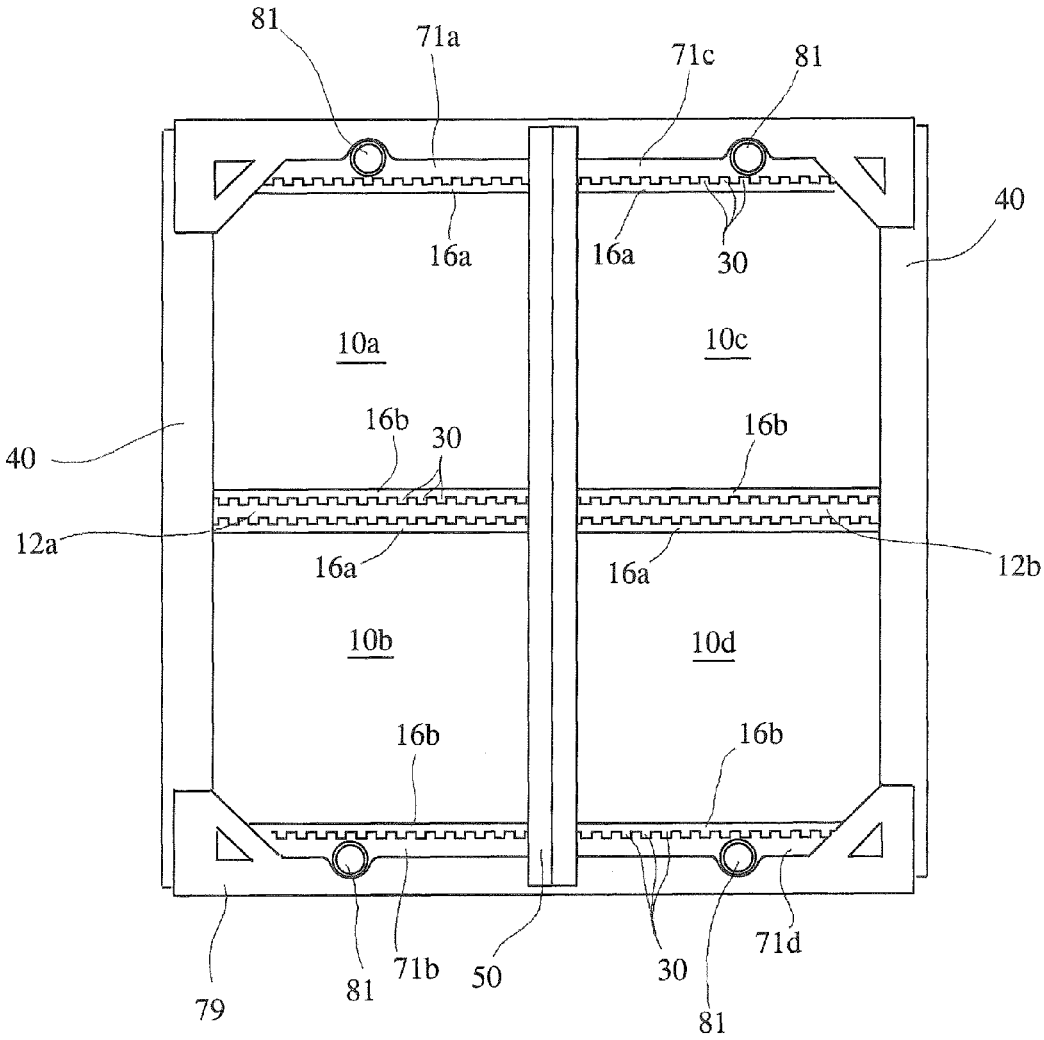
FIG. 2 is a front elevational view of a modular heat exchanger according to the present invention.

FIG. 2 shows a front elevational view of the first embodiment of the modular heat exchanger according to the present invention. The modular heat exchanger includes a plurality of aluminum radiator or other heat exchanger cores 10 integrally connected to a plurality of radiator tanks 71. The cores include parallel vertical tubes and fins between the tubes for increased heat exchange efficiency, and are preferably CAB cores. The aluminum cores 10 each include a first header 16*a* at the top end of the core and a second header 16*b* at the bottom of the core. The modular heat exchanger shown includes four identical cores 10*a*, 10*b*, 10*c*, 10*d*. Vertically adjacent cores 10*a*, 10*c* are connected such that the bottom header 16*b* of core 10*a* is sealingly connected with the top header 16*a* of core 10*b* using a filler frame or connector member 12*a*. Likewise, vertically adjacent cores 10*c*, 10*d* are connected using a similar filler frame or connector member 12*b* secured between bottom header 16*b* of core 10*c* and top header 16*a* of core 10*d*. The filler frame or connector member 12*a*, 12*b* of FIG. 2 are shown in perspective and cross sectional views in FIGS. 3 and 4 respectively, and is an elongated member having a length approximately equal to the width of the cores and a width approximately equal to the depth of the cores. The length of the filler frame is typically greater than the width. An opening on the top and bottom of filler frame member 12 permits passage of coolant between the vertically connected cores, and the filler frame member includes a laterally outwardly extending top foot or lip 14*a* and a laterally outwardly extending bottom foot or lip 14*b* along the perimeter of each of the openings to permit the filler frame member to be sealingly secured with gaskets 18 to the headers of each of the cores. The filler frame members may be made of any suitable material, for example a plastic such as glass reinforced nylon or a metal such as formed aluminum extrusion attached to end caps.

Figure 4:
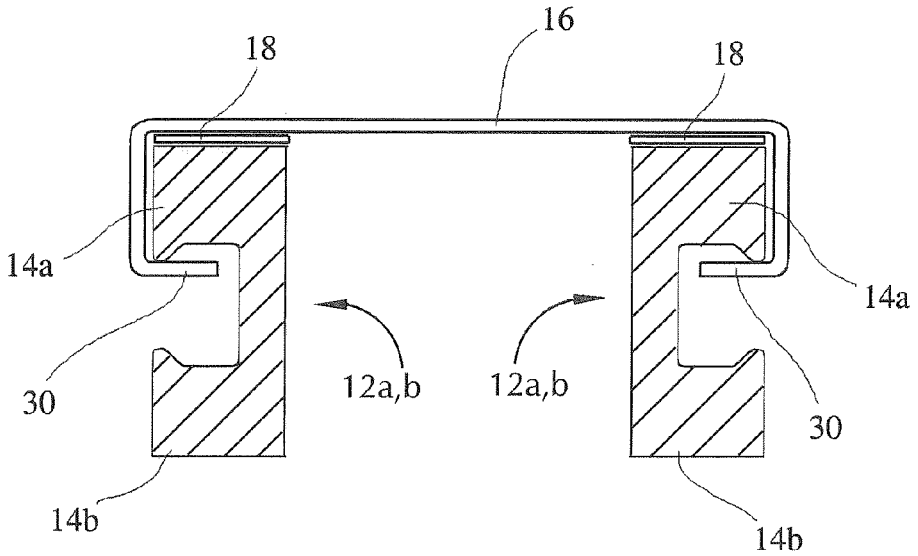
FIG. 4 is a cross sectional view of the filler frame of FIG. 3 with a header crimped thereto according to the present invention.

Each heat exchanger header 16*a*, 16*b*, 16*c*, 16*d* includes a plurality of tabs 30 along the perimeter of the core header 16 (FIG. 2) which fold around or are crimped to the adjacent lip of the filler frame 12 or the tank 71 using an intermediate elastomeric gasket 18 (FIG. 4). The connection and method for connection of such tabs are also described in U.S. patent application Ser. No. 11/761,691 hereby incorporated by reference.

Figure 5:
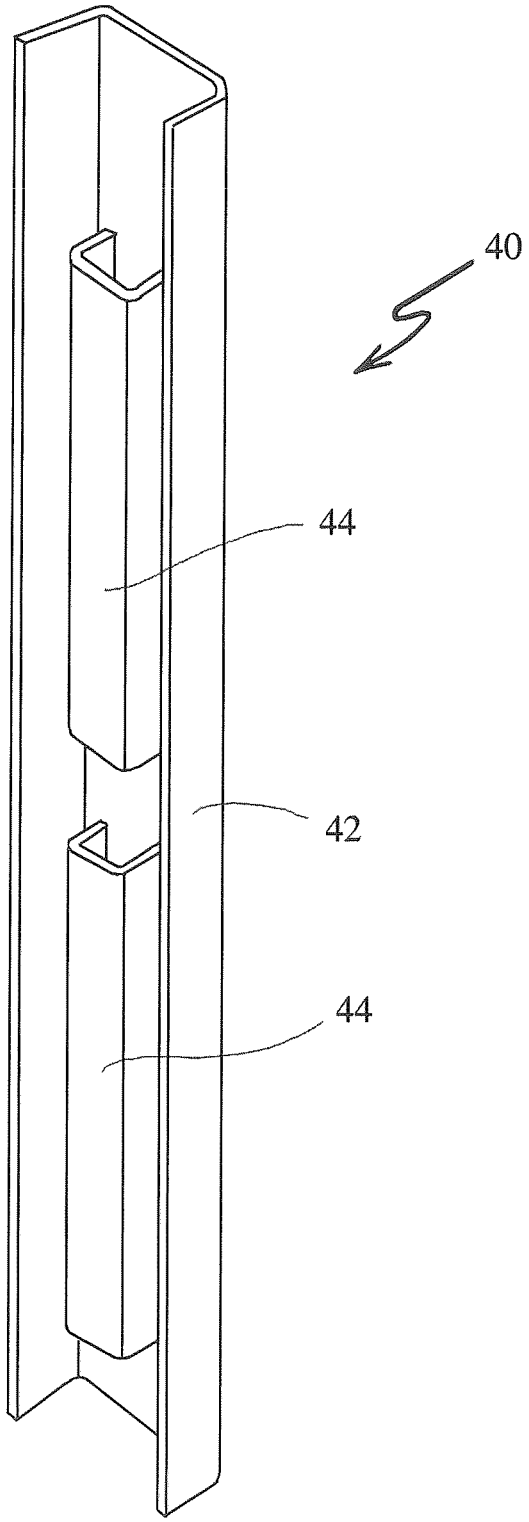
FIG. 5 is a perspective view of a structural side member according to the present invention.
Figure 6A:
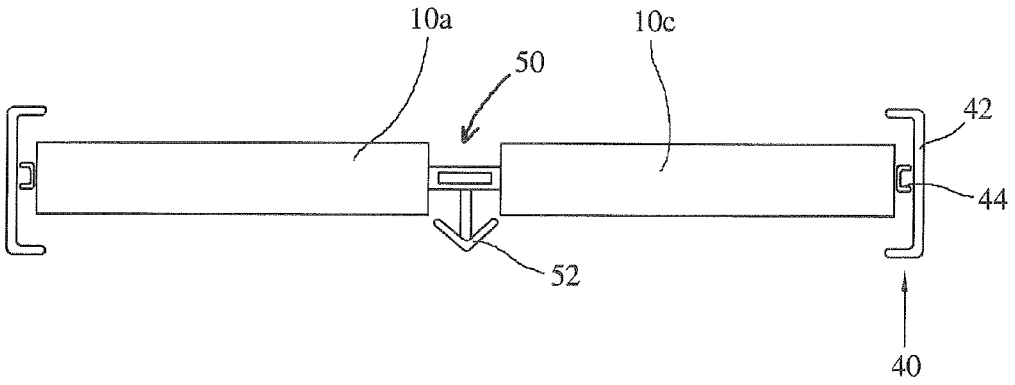
FIG. 6A is a top elevational view of the modular heat exchanger with structural side members and a first embodiment of the core support member according to the present invention.
Figure 6B:
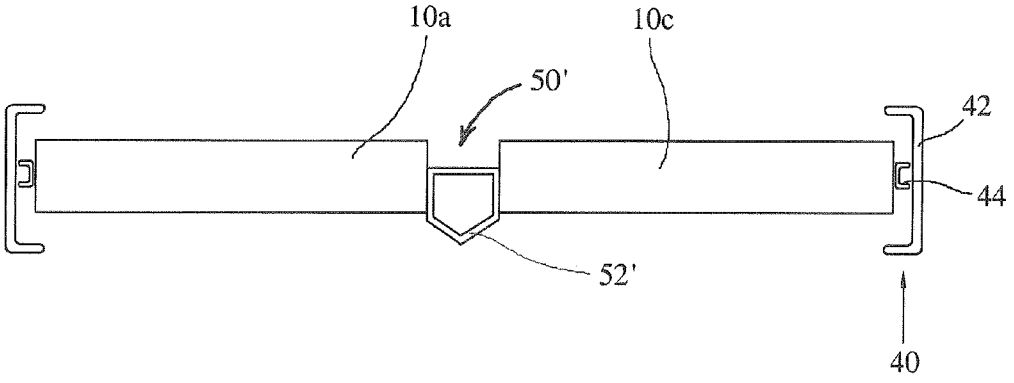
FIG. 6B is a top elevational view of the modular heat exchanger with structural side members and a second embodiment of the core support member according to the present invention.

The preferred modular heat exchanger assembly (FIG. 2) also includes separate upper radiator or coolant tanks 71*a*, 71*c* sealingly connected to the top header 16*a* of cores 10*a*, 10*c*, respectively, and separate lower radiator or coolant tanks 71*b*, 71*d* sealingly connected to the bottom header 16*b* of cores 10*b*, 10*d*, respectively. The tanks 71, each have an inlet/outlet 81 for connection to an internal combustion engine or other external system. Tank 71 may be made of any material, such as a suitable glass reinforced plastic. Structural side members 40 are provided as shown in FIGS. 2 and 5 and include an elongated external channel portion 42 and a smaller elongated internal channel portion 44. The structural side members 40 are disposed adjacent heat exchanger cores along the left and right side of the modular heat exchanger and are used to protect and support the core sides and to substantially eliminate air flow bypass around the sides of the cores. An elongated core support member 50 shown in FIGS. 2 and 6A performs a similar task as the structural side members 40 and extends between upper and lower headers of the cores. A second embodiment of the elongated core support member 50' is shown in FIG. 6B. Upper and lower frame members 79 attach to structural side members 40 to provide a rigid protective frame for the modular heat exchanger assembly. Core support members 50, 50' have a V-shaped front portion 52, 52', respectively, with the apex pointing in the direction of the entering air for forcing the air to either side of the support member to prevent air flow bypass between the cores and to maximize the air flow through the heat exchanger cores.

The cores may be connected in a single-pass arrangement, so that coolant flow would be split and enter both the top tanks, travel down through the connected cores, and flow out the opposite bottom tanks. This single-pass flow may also be reversed, in an up-flow direction. Alternatively, the cores may be connected in a parallel or two-pass arrangement so that all of the coolant would enter one top tank, travel down through the connected cores, flow out the opposite bottom tank, enter the adjacent bottom tank, flow up through the connected cores, and flow out the opposite top tank. This two-pass flow may also be reversed.

Where an existing heat exchanger would be replaced in its entirety, a user would select from a selection of different fixed heat exchanger core assembly sizes the number needed in each row and column to replace the existing heat exchanger. The heat exchanger cores in each column would be connected and sealed to adjacent ones by filler frame members, and adjacent columns of heat exchanger cores would have a core support member disposed therebetween. The upper and lower radiator tanks would be connected and sealed across the top and bottom of the side-by-side columns of heat exchanger cores, and the upper, lower and side support members would be added to complete the replacement heat exchanger.

In another embodiment of the present invention, aluminum heat exchanger cores are adapted for use in large industrial heat exchangers. This second embodiment of the invention consists of two parts. The first part is an assembly group of PTA radiators designed to replace a large, possibly multi-cored copper/brass core assembly in an existing large industrial or vehicular radiator. The PTA radiators in this assembly group are joined together vertically by means of a filler frame, in the same manner as in the first embodiment. A difference between the PTA radiators of this embodiment and those of the first embodiment is that the top tanks of the upper radiators and the bottom tanks of the lower radiators are specially made to have a row of tubular protrusions opposite the core header opening. The second part of the second embodiment is an adapter kit to join the assembly group of PTA radiators to the top and bottom tanks of the existing radiator. The adapter kit includes a top adapter header plate having mounting holes to connect to the existing top tank and collared holes to mate with the protrusions on the top tanks of the upper PTA radiators, a gasket to seal the top adapter header plate to the existing radiator top tank, and elastomeric grommets to seal the tubular protrusions of the top tanks of the upper PTA radiators to the collared holes of the top adapter header plate. Similarly, the adapter kit includes a bottom adapter header plate (often a different size from the top adapter header), a gasket and elastomeric grommets to seal the tubular protrusions of the bottom tanks of the lower PTA radiators to the collared holes of the bottom adapter header plate.

Figure 7:
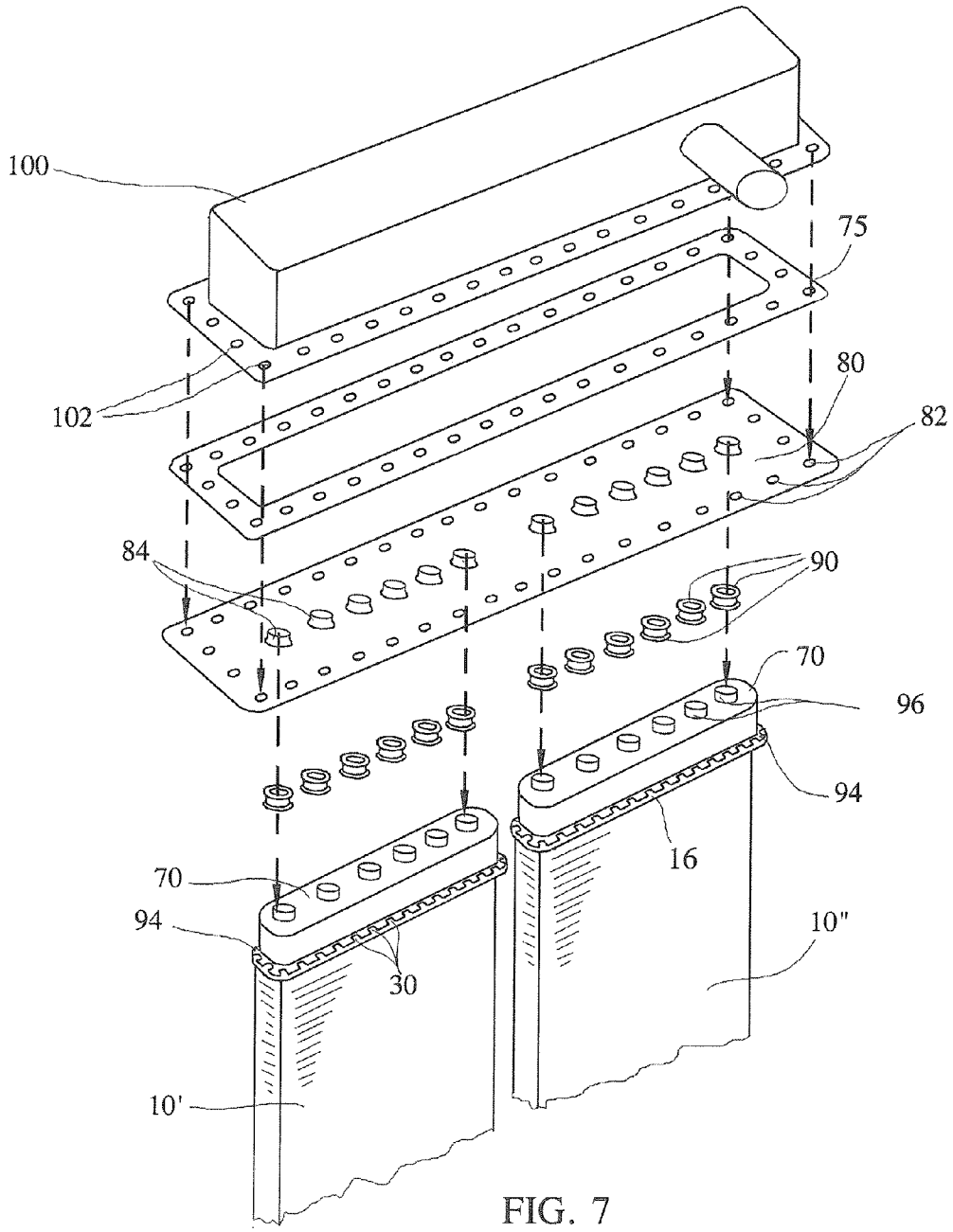
FIG. 7 is a perspective view of the modular heat exchanger first and second adapters according to the present invention.
Figure 8:
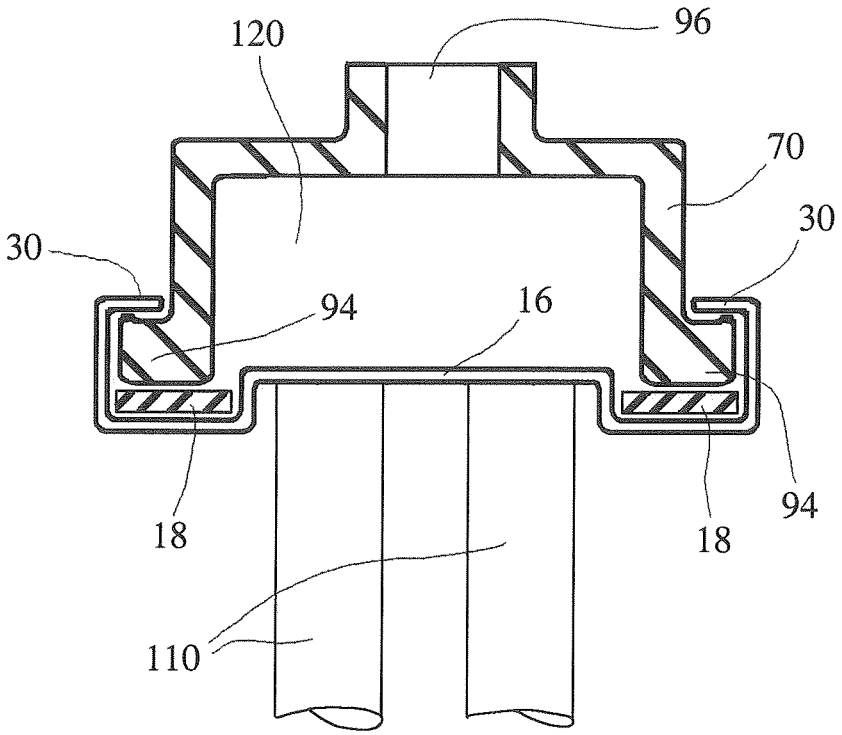
FIG. 8 is a side elevational view of the first adapter of FIG. 7 according to the present invention.

FIG. 7 shows two heat exchanger cores 10', 10" connected to an upper radiator or coolant tank 100 and sealed with gasket 75. This embodiment comprises a kit or system for adapting modular CAB aluminum cores to existing large industrial radiators. As seen in the industrial radiator in FIG. 1, the core header 78 is a flat sheet of brass with oval holes 76 in the interior portions for insertion and soldering of the core tubes and openings 74 around the outer perimeter for fasteners used to connect the tank, gasket and header. In order to allow aluminum cores to replace the copper cores of the industrial radiator, adapters as shown in FIG. 7 are included. The first adapter 70, also shown in a side elevational view of FIG. 8, is a plastic or glass reinforced nylon tank having a laterally outwardly extending foot or lip 94 aligned with the core header 16 such that the tabs 30 along the core header will crimp around the lip and allow the first adapter and header to be sealed with an elastomeric gasket 18. The opposite side of the first adapter includes tubular protrusions 96 for fluid to flow through. Tubes 110 are shown extending downward from the core header 16.

A second adapter, header 80, is a metal plate, preferably brass, having fastener openings 82 along the plate perimeter corresponding with the fastener openings 102 of the industrial radiator tank 100, and sealed to the radiator tank by means of gasket 75. The second adapter includes collared openings 84 for flow of coolant which correspond to the tubular protrusions 96 of the first adapter 70. Cylindrical elastomeric grommets or seals 90 allow the tubular protrusions to be sealed with the collared openings. A lower radiator tank (not shown) may be provided in the heat exchanger which is joined to the lower ends of the heat exchanger cores using the adapter tank 70, elastomeric gaskets 18, grommets 90, adapter header plate 80 and gasket 75 in the same manner as the upper radiator tank. The structural side members 50 shown in FIGS. 5 and 6 may be used to attach to the ends of the upper radiator tank 100 and the lower radiator tank (not shown) to maintain the desired spacing between these tanks.

Figure 1:
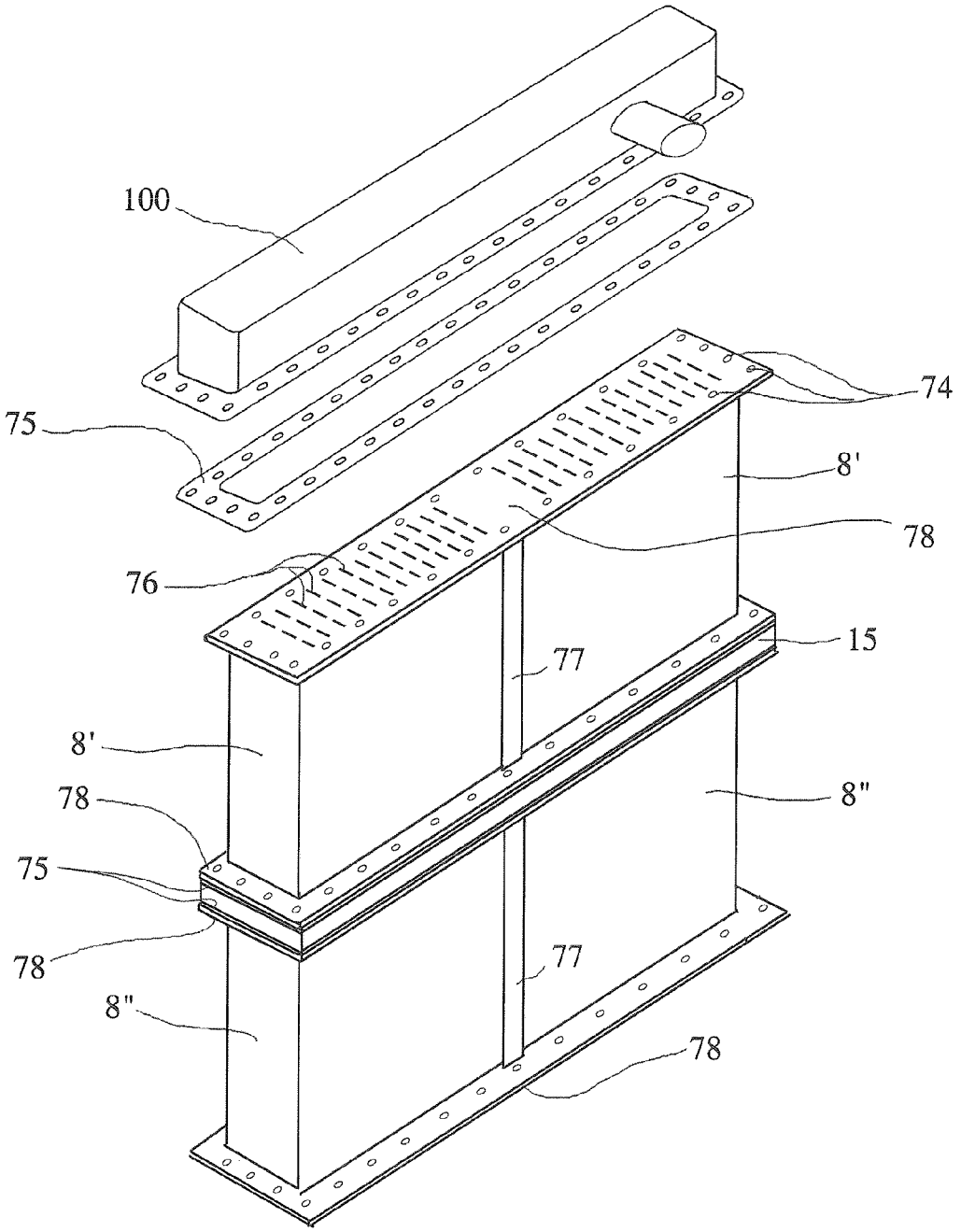
FIG. 1 (PRIOR ART)
FIG. 1 is a perspective view of a portion of a prior art radiator assembly using modular cores.

This embodiment provides the steps and apparatus to convert the industrial copper/brass core radiator of FIG. 1 to an industrial radiator using the aluminum cores of FIG. 7 while reusing the existing tanks. The existing upper radiator tank 100 and bottom radiator tank (not shown) are first unfastened from the corresponding headers 78 and the copper/brass cores 8 and headers 78 are removed. A first adapter 70 is provided having a lip 94 aligned with a header of an aluminum core 10. The tabs 30 along the core header are crimped around the lip 94 whereby the first adapter and header are sealed with an elastomeric gasket 18 (FIG. 8). The opposite side of the first adapter includes tubular protrusions 96 for fluid to flow through. A plurality of cylindrical elastomeric grommets or seals 90 are then inserted into collared openings 84 of a second adapter plate 80 having fastener openings 82 along the plate perimeter corresponding with the fastener openings 102 of the industrial tank 100. The tubular protrusions 96 of the first adapter are then urged into and sealed with the cylindrical elastomeric seals 90, additionally sealing the tubular protrusions with the collared openings 84 of the second adapter plate 80. The second adapter plate is then fastened to the radiator tank 100 using the existing gasket 75, or a similar gasket 75 preferably provided with the adapter kit. The lower radiator tank is then attached to the opposite, lower ends of the modular aluminum cores using the steps above.

Figure 3:
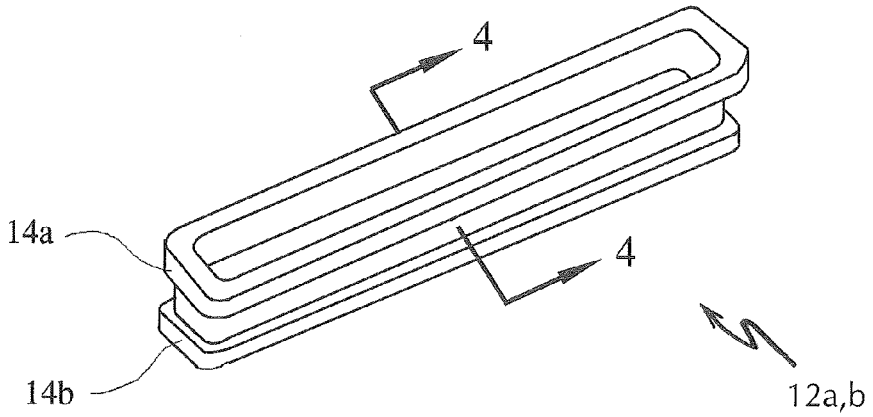
FIG. 3 is a perspective view of a filler frame according to the present invention.
Figure 9:
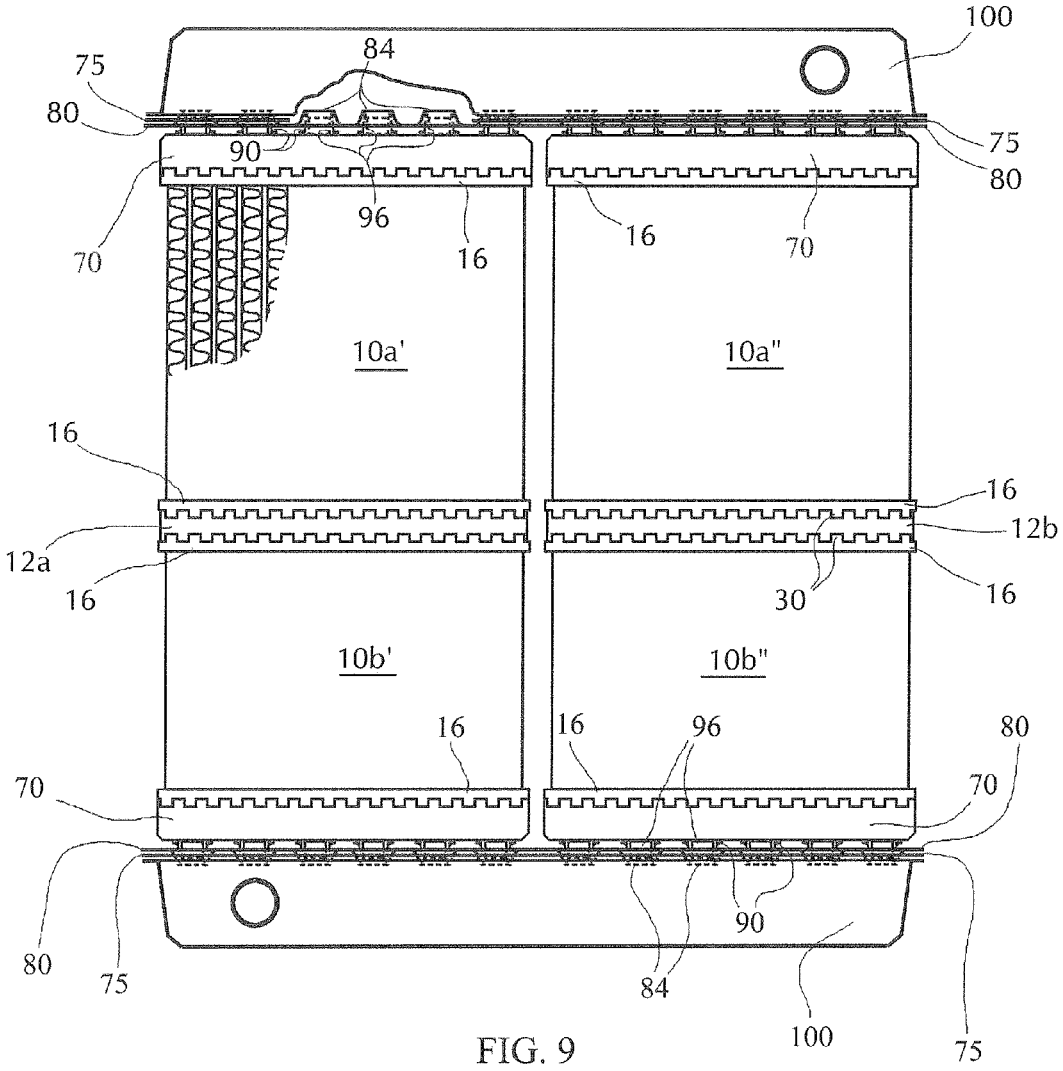
FIG. 9 is a front elevational view of the assembled modular heat exchanger of FIG. 7 with a cutaway of the radiator tank and including the filler frame member of FIGS. 3 and 4.

Additionally, the lower ends of the cores 10' and 10" may be joined to additional cores in the same manner depicted in FIG. 2-4 and described above using filler frame members 12*a*, 12*b*. FIG. 9 is a front view of the assembled modular heat exchanger which includes the adapter tank 70, adapter header plate 80 and the elastomeric grommets 90 of FIG. 7 for connecting upper heat exchanger cores 10*a*', 10*a*" to the upper radiator tank 100' and lower heat exchanger cores 10*b*', 10*b*" to the lower radiator tank 100" as described above. The assembled modular heat exchanger also includes the elongated filler frame members 12*a*, 12*b* of FIGS. 3 and 4 for connecting the upper heat exchanger cores 10*a*', 10*a*" with the lower heat exchanger cores 10*b*', 10*b*" as described above.

The modular heat exchanger according to the present invention may include any number of heat exchanger cores, in series, parallel or in combination. The cores shown in FIG. 2 are in a 2×2 row and column arrangement. If each core were 36 in. (0.91 m) high×36 in. (0.91 m) wide, the final modular heat exchanger core would be about 72 in. (1.83 m) high (plus the height of the filler frame member)×72 in. (1.83 m) wide (plus the width of the center core support member). Additional rows or columns may be provided, in 2×3, 3×2, 3×3 or more arrangements to use smaller individual core sizes, or to create larger modular cores.

Where existing radiator tanks are to be reused, a user would be provided with one or more heat exchanger core assemblies, each having adapter tanks 70 already attached and sealed to opposite ends of the heat exchanger core. The user would also be provided with an adapter kit that would include two adapter header plates 80 (for the top and bottom), gaskets for sealing the adapter header plates to the existing radiator tanks, and a set of grommets for sealing the adapter tanks to the adapter header plates.

Thus, the present invention provides an improved system and method for creating a large radiator core using a plurality of smaller CAB aluminum core modules. The invention further provides an improved adapter assembly and method of assembly of aluminum core modules to replace copper/brass cores in existing large industrial radiators. The modular heat exchanger assembly of the present invention also maximizes air flow over the heat exchanger core.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A modular heat exchanger core assembly comprising:

a plurality of heat exchanger cores, each heat exchanger core having a width and including a plurality of tubes, fins between the tubes and opposing headers sealingly attached at each end of the tubes, each header having at least one tab along the perimeter thereof; and at least one elongated filler frame member having an opening extending therethrough substantially spanning the width of the heat exchanger cores and opposing lips extending completely around a perimeter of each end of the opening, the lips being spaced from each other, each lip corresponding with an adjacent heat exchanger core header, the at least one tab of each adjacent heat exchanger core header being secured to one of the filler frame member lips to connect at least two of the heat exchanger cores.

2. The modular heat exchanger core assembly of claim 1 wherein the filler frame member has a length corresponding to a width of the heat exchanger cores, and a width corresponding to the depth of the heat exchanger cores.

3. The modular heat exchanger core assembly of claim 1 including a pair of opposing side members adapted to provide structural support to the heat exchanger cores and to substantially eliminate air flow bypass around the sides of the cores.

4. The modular heat exchanger core assembly of claim 1 including a core support member centered between two heat exchanger cores and shaped to have an apex pointing in the direction of entering air for forcing the air to either side of the support member and direct air flow to the fins and tubes of the heat exchanger cores.

5. The modular heat exchanger core assembly of claim 1 including:

a pair of opposing side members adapted to provide structural support to the heat exchanger cores and to substantially eliminate air flow bypass around the sides of the cores; and a core support member centered between two heat exchanger cores and shaped to have an apex pointing in the direction of entering air for forcing the air to either side of the support member and direct air flow to the fins and tubes of the heat exchanger cores.

6. A modular heat exchanger core assembly comprising a filler frame member securing a first heat exchanger core to a second heat exchanger core, the heat exchanger cores having a width, the filler frame member comprising openings on opposite ends thereof and extending through the member, each opening substantially spanning the width of the heat exchanger cores and having a lip extending therefrom completely around a perimeter of the opening, the lips being spaced from each other around the perimeter of the openings, the filler frame connecting a header of the first heat exchanger core to a header of the second heat exchanger core by header tabs on each heat exchanger core deformed around the lip on opposite ends of the filler frame.

7. The modular heat exchanger core assembly of claim 6 wherein the filler frame member has a length corresponding to a width of the heat exchanger cores, and a width corresponding to the depth of the heat exchanger cores.

8. The modular heat exchanger core assembly of claim 6 wherein the filler frame is plastic.

9. The modular heat exchanger core assembly of claim 6 wherein the filler frame is reinforced nylon.

10. The modular heat exchanger core assembly of claim 1 further including a gasket for sealing the filler frame to an adjacent heat exchanger core header.

11. The modular heat exchanger core assembly of claim 2 further including a gasket for sealing the filler frame to an adjacent heat exchanger core header.

12. The modular heat exchanger core assembly of claim 6 further including gaskets for sealing each of the filler frame lips to the heat exchanger core headers.

13. The modular heat exchanger core assembly of claim 7 further including gaskets for sealing each of the filler frame lips to the heat exchanger core headers.

14. A modular heat exchanger core assembly comprising:

two sets of vertically adjacent heat exchanger cores, each heat exchanger core including a plurality of tubes, fins between the tubes and opposing headers sealingly attached at each end of the tubes, each header having at least one tab along the perimeter thereof;

an elongated filler frame member between each set of vertically adjacent heat exchanger cores, each elongated filler frame member having an opening extending therethrough and opposing lips extending around each end of the opening, the lips being spaced from each other, each lip corresponding with an adjacent heat exchanger core header, the at least one tab of each adjacent heat exchanger core header being secured to one of the filler frame member lips to connect at least two of the heat exchanger cores; and a core support member centered between the two sets of vertically adjacent heat exchanger cores and shaped to have an apex pointing in the direction of entering air for forcing the air to either side of the support member and direct air flow to the fins and tubes of the heat exchanger cores.

15. A modular heat exchanger core assembly comprising:

two sets of vertically adjacent heat exchanger cores, each heat exchanger core including a plurality of tubes, fins between the tubes and opposing headers sealingly attached at each end of the tubes, each header having at least one tab along the perimeter thereof;

an elongated filler frame member between each set of vertically adjacent heat exchanger cores, each elongated filler frame member having an opening extending therethrough and opposing lips extending around each end of the opening, the lips being spaced from each other, each lip corresponding with an adjacent heat exchanger core header, the at least one tab of each adjacent heat exchanger core header being secured to one of the filler frame member lips to connect at least two of the heat exchanger cores;

a pair of opposing side members along the two sets of vertically adjacent heat exchanger cores adapted to provide structural support to the heat exchanger cores and to substantially eliminate air flow bypass around the sides of the cores; and a core support member centered between the two sets of vertically adjacent heat exchanger cores and shaped to have an apex pointing in the direction of entering air for forcing the air to either side of the support member and direct air flow to the fins and tubes of the heat exchanger cores.

* * * * *